US005927222A

United States Patent [19]

Eakin et al.

[11] Patent Number: 5,927,222

[45] Date of Patent: Jul. 27, 1999

[54] DRYDOCK POLLUTION CONTROL SYSTEM AND PROCESS

[76] Inventors: Frank W. Eakin, 2302 Country Pl., Richmond, Tex. 77469; Guy S. Eakin, 210 Glendover Rd., Lexington, Ky. 40503

[21] Appl. No.: 08/738,537

[22] Filed: Oct. 28, 1996

[51] Int. Cl.[6] ..... B63C 1/02

[52] U.S. Cl. ..... 114/45; 405/4

[58] Field of Search ..... 114/45, 44, 47; 405/4, 60; 210/238, 489, 498, 499, 767

[56] References Cited

U.S. PATENT DOCUMENTS

| | | | |
|---|---|---|---|
| 1,397,339 | 11/1921 | Sturtevant . | |
| 1,879,377 | 9/1932 | McNeely . | |
| 2,061,850 | 11/1936 | Roberts | 210/76 |
| 2,723,032 | 11/1955 | Gisler et al. | 209/401 |
| 3,176,843 | 4/1965 | Hoskins et al. | 209/403 |
| 3,581,505 | 6/1971 | Liddell | 61/46 |
| 3,786,773 | 1/1974 | Preus | 114/45 |
| 3,870,009 | 3/1975 | Liddell | 114/222 |
| 3,900,628 | 8/1975 | Stewart | 428/134 |
| 4,000,618 | 1/1977 | Stovall | 61/1 F |
| 4,033,865 | 7/1977 | Derrick, Jr. | 209/275 |
| 4,380,494 | 4/1983 | Wilson | 209/319 |
| 4,495,072 | 1/1985 | Fields | 210/238 |
| 4,575,521 | 3/1986 | Derrick et al. | 209/397 |
| 4,786,604 | 11/1988 | Michael | 436/77 |
| 4,787,179 | 11/1988 | Lewis | 51/426 |
| 4,949,512 | 8/1990 | Thomann | 51/426 |
| 5,039,618 | 8/1991 | Stone | 436/77 |
| 5,154,537 | 10/1992 | Devries et al. | 405/60 |
| 5,211,125 | 5/1993 | Garland et al. | 114/222 |
| 5,353,729 | 10/1994 | Goldbach et al. | 114/222 |
| 5,355,823 | 10/1994 | Goldbach et al. | 114/222 |
| 5,398,632 | 3/1995 | Goldbach et al. | 114/222 |
| 5,492,835 | 2/1996 | Koenig | 436/77 |

FOREIGN PATENT DOCUMENTS 743902 1/1956 United Kingdom .

OTHER PUBLICATIONS

Lead Check Swabs Test Confirmation Card, ©1993 HybriVet Systems, Inc. Natick, MA (one page) Note: indicates above U.S. Patent No. 5,039,618 thereon.

ASTM Designation: A123–89a—Standard Specification for Zinc (Hot–Dip Galvanized) Coatings on Iron and Steel Products (4 pages). Date unknown.

(List continued on next page.)

*Primary Examiner*—Ed L. Swinehart

*Attorney, Agent, or Firm*—Pravel, Hewitt, Kimball & Krieger

[57] ABSTRACT

A pollution control system to control pollutants in water surrounding a drydock includes a housing extending from each end of the drydock wing walls about the perimeter of the drydock so as to completely encircle an inboard deck of the drydock. The drydock moves between a floating position to a submerged position upon filling drydock buoyancy tanks with water. The housing includes a slot to allow positioning of a removable screen in an opening in the top of the housing. The screens allow the water to flow to and from the deck, as the deck moves between the floating position and the submerged position. A baffle plate is positioned inboard of the housing on the drydock deck to inhibit movement of pollutants between the baffle plate and the housing. Advantageously, a process for reducing pollutants in water surrounding a drydock includes removal of the screen from the housing to protect it from ultraviolet effects or from welding operations during maintenance and repair of a drydocked vessel.

20 Claims, 5 Drawing Sheets

OTHER PUBLICATIONS

Zinc Coated Steel Mesh Filters, Supplier—Grainger, 4545 Darien, Houston, Tx 77028; Manufacturer—The George Evans Corporation, Moline, Il 61265, Evans Model No. 20252AGS and Stock No. 4C409 (one page). Date unknown.

Pit & Quary, Nov., 1981—Wider vibrating screens: bigger can be better, by J.P. Nichols, pp. 78–79 and 81.

Pit & Quary, Nov., 1982—Proper installation and maintenance: keys to longer screen life, by David W. Owens, pp. 54–58.

Pit & Quary, Jun., 1983—Factors influencing the selection of urethane screen sections, by Norman M. Godfrey, pp. 52–55.

Pit & Quary, Jun., 1983—Screening material: one man's opinion, by Delbert L. Olson, pp. 61–62.

Pit & Quary, Jun., 1983—Polyurethane: a cost–effective screening alternative, by James C. Voelkel, pp. 70–73.

World Oil, Aug. 1, 1981—Tests reveal shaker screen efficiencies, by W.S. Cagle, pp. 91–94.

Oil & Gas Journal, Jan, 18, 1982 Technology, Shale–Shaker Selection and Operation–5, Flow limits for unconventional shaker screens by L.L. Hoberock, pp. 92–94 and 99–101.

Coal Mining & Processing, Sep., 1979, New dimensions for vibrating screens, by Eric Ohl, pp. 80–82.

Coal Age, Jan., 1976, The role of vibrating screens in modern coal preparation plants, by George E. Groseclose, pp. 92–96.

©1980 The Brandt Company, Jun. 15, 1980—6M1079CLH&A5917 Composite Catalog, 8 Pages.

Wayne Wire Cloth Products, Inc.—Brochure, 15 Pages. Date unknown.

Metal Fabrics, Laminates and Elements in Industrial Filtration, by Leonard J. Ortino and Harry M. Kennard, Cover Page and pp. 1–18. Date unknown.

Federal Water Pollution Control Act, as Amended by the Clean Water Act of 1977 including up to PL 104–66, Dec. 21, 1995 Sec. 101 [33 USC 1251] Declaration of Goals and Policy, Sec. 301 [33 USC 1311]Effluent Limitations.

Federal Register Vol. 60, No. 189 Friday, Sep. 29, 1995, Notices for R. Storm Water Discharges Associated with Industrial Activity from Ship and Boat Building of Repairing Yards. pp. 50992 to 50998.

ARMORLON®—Design to meet your Abrasive—Blasting and Painting Requirements, ©1991 Reef Industries, Inc. of Houston, Texas (4 pages total).

ATG–6–Fire Retardant, Mar. 22, 1996 Reef Industries, Inc. of Houston, Texas (one page total).

Custom Metals Fabrication Jestex Houston, Jestex, Inc. of Houston, Texas manufacturer of Model #0001 galvanized expanded metal (4 pages total). Date unknown.

Texas Natural Resource Conservation Commission Permit No. 02034 issued Aug. 4, 1995 with Effluent Limitations and Monitoring Requirement—Outfall No. 001 and Table 1—NPDES General Permit Texas Section (401) Certificate Conditions. (3 pages total).

MBA labs/houston labs, Laboratory Identification J66955–1, date received May 19, 1996 and date completed Jul. 25, 1996 (17 pages total).

MBA labs/houston labs, Laboratory Identification J67070–1, date received May 24, 1996 and date completed Jul. 25, 1996 (17 pages total).

MBA labs/houston labs, Laboratory Identification J67073–1, date received May 25, 1996 and date completed Jul. 25, 1996 (17 pages total).

MBA labs/houston labs, Laboratory Identification J67237–1, date received Jun. 5, 1996 and date completed Jul. 25, 1996 (17 pages total).

Elements of Materials Science and Engineering, Third Edition, Lawrence H. Van Vlack ©1975, 1964, 1959 by Addison–Wesley Publishing Company, Inc., cover page, ©notice page, and pp. 445, 470, 471 (5 pages total).

McGraw–Hill Encyclopedia of Science & Technology, 5th Edition, Copyright ©1982, 1977, 1971, 1966, 1960 by McGraw–Hill, Inc. cover page, ©notice page, and pp. 400, 401, 402, 403 404 (7 pages total).

FIG. 4
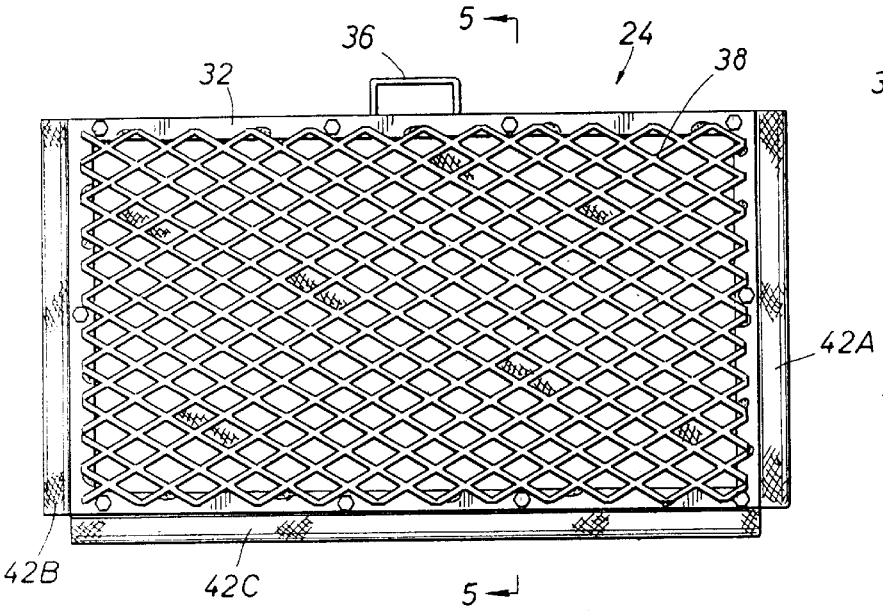
FIG. 5
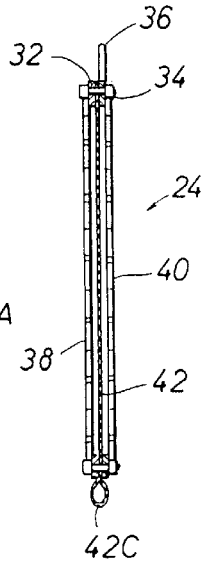
FIG. 6
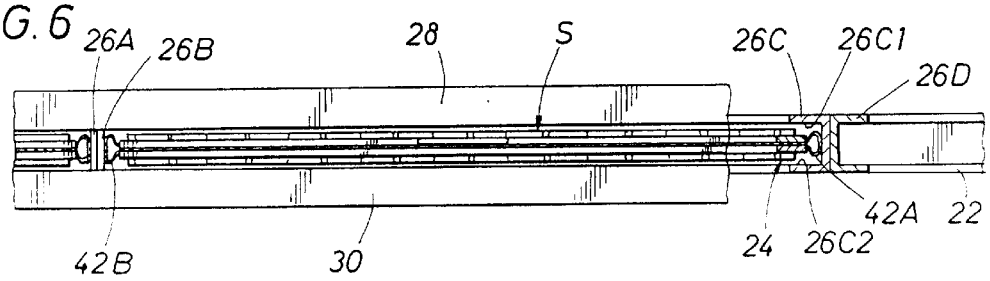
FIG. 7
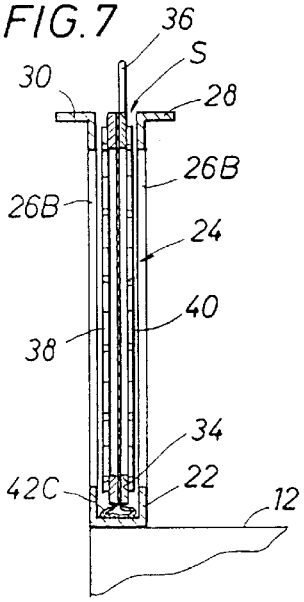
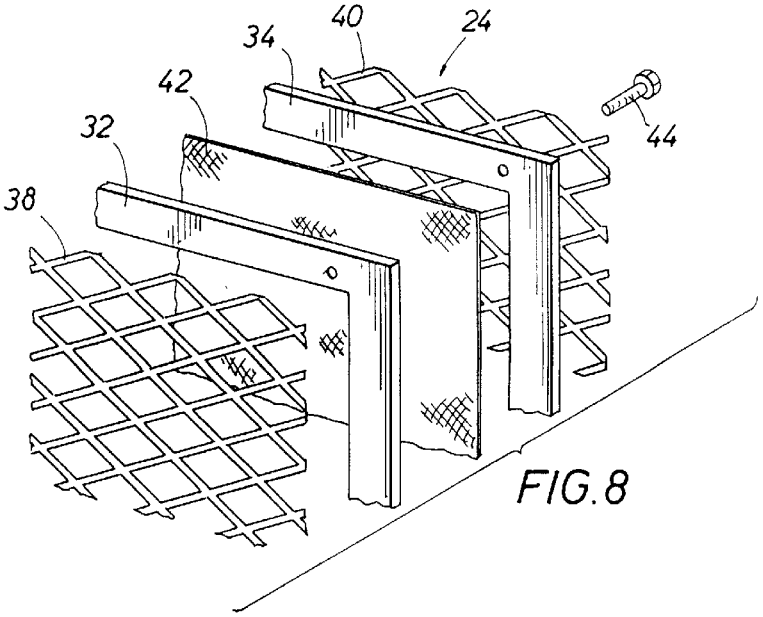
FIG. 8

FIG. 9
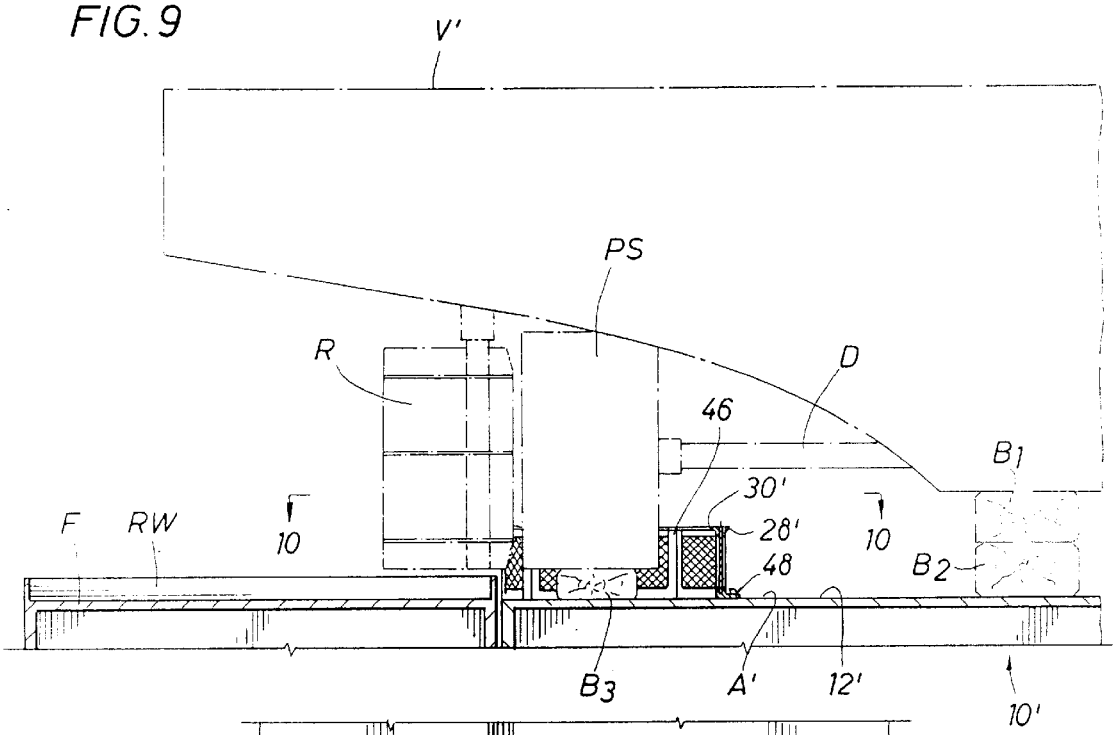
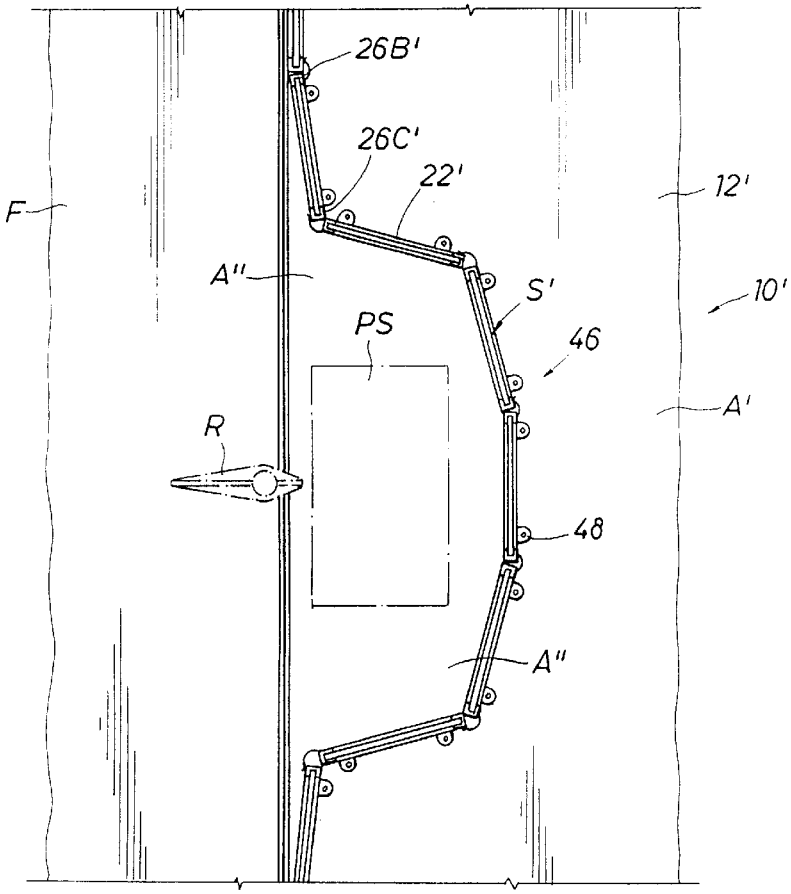
FIG. 10

DRYDOCK POLLUTION CONTROL SYSTEM AND PROCESS

FIELD OF THE INVENTION

The present invention relates to a pollution control system and process to reduce pollutants. In particular, the present invention relates to a pollution control system and process to reduce pollutants in water surrounding a drydock upon flooding or submersion of the drydock.

BACKGROUND OF THE INVENTION

Apparatus and methods for performing work on vessel hulls in a drydock have been known in the past. For example, U.S. Pat. Nos. 5,211,125; 5,353,729; 5,355,823; and 5,398,632, which are incorporated herein for all purposes, propose apparatus and methods for performing external surface work on ship hulls.

Vessels, which include ships, boats and barges, are positioned on a drydock for building and repairing. Generally, a drydock is a large floating vessel used by shipyards to lift barges, boats, and ships so that repair work may be performed on them out of the water. Drydocks often have many structural steel beams which run across the deck or top surface to add strength as well as multiple blocks, which are often fabricated from wood, on which the vessels rest. Most drydocks include wing walls on each side of the drydock. These wing walls contain buoyancy tanks which are filled with water to submerge the drydock.

It has also been known in the past that when a vessel overhangs beyond the end of a drydock, floating, but not submersible, floats or barges can be placed beneath the overhanging portion of the vessel to catch pollutants, such as, spent abrasives from sandblasting, paint chips, rust and dust.

One known method for controlling pollutants, such as spent abrasives, accumulated in sandblasting operations on a vessel is to allow the pollutants to fall through a grating which replaces the deck or top surface on which the workers stand. The pollutants fall through the grating land in a chamber, where the pollutants are later moved to shore by means of pumping.

The Environmental Protection Agency ("EPA") has promulgated regulations related to the "Best Management Practices" ("BMP") for ship and boat building and repairing yards in volume 60, number 189 of the Sep. 29, 1995 Federal Register. The EPA has identified the common pollutant sources at ship and boat building and repairing facilities. For example, activities such as surface preparation, paint removal and sanding involve sanding, mechanical grinding and abrasive blasting with resulting pollutants of spent abrasives, paint chips, rust and dust. Also, the activity of painting involves paint and paint thinner, spray painting, sanding and paint cleanup with resulting pollutants of paint chips, rust and dust.

To control these resulting pollutants from these drydock activities, the EPA Best Management Practices provide for storm water pollution prevention relating to certain activities at ship and boat building and repairing facilities including 1.) surface preparation, sanding and paint removal, 2.) painting, 3.) drydock maintenance, and 4.) drydock activities. One such practice that the EPA suggests for surface preparation, sanding, paint removal and drydock maintenance is sweeping the drydock before each submersion to minimize potential for pollutants. However, sweeping large drydocks is highly labor intensive and consumes significant dock time, making the process excessively expensive.

In order to comply with Sec. 101 of the Federal Water Pollution Control Act, as amended by the Clean Water Act of 1977 (FWPC), shipyards should not discharge water, which comes into contact with pollutant sources, without removing the pollutants. Thus, if pollutants are not swept from a drydock before submersion, an approved control device must prevent such pollutants from entering the water during submersion.

Another BMP identified by the EPA for drydock activities is the use of plastic barriers hung from the wing walls of the drydock, from the bow or stern of the vessel, or from temporary structures for containment of abrasives, paint chips and overspray. U.S. Pat. No. 4,787,179 discloses an abrasive blasting containment land based system for cleaning large steam turbines.

Shipyards have been known in the past to use lightweight polypropylene containment to reduce emissions of sand, dust and overspray to the atmosphere. This "ARMORLON" containment material has been recommended for shipyard barge blasting by Reef Industries, Inc. of Houston, Texas. However, this containment method, as recommended by the EPA, does not address the above discussed problem of the high costs associated with sweeping of a drydock before each submersion.

Therefore, there has been and is a need, as identified by the above EPA promulgation, in the ship and boat building and repair industry for a way to cost effectively control pollutants in drydock activities, to comply with the FWPC, EPA and state authorities regulations for effluent limitations of pollutants from a drydock used in construction, repairing and cleaning of ships, barges, tugs, and boats. In particular, a process and system for reducing the labor intensive clean up of pollutants created during surface preparation, sanding, paint removal, painting and other drydock activities while properly controlling pollutants would be highly desirable.

In summary, it would be highly desirable to have a system and process that would control pollutants to a level below maximum allowable regulatory effluent limitations for water, without the labor intensive task of sweeping the entire drydock deck or top surface before the submersion of the drydock.

SUMMARY OF THE INVENTION

A drydock pollution control system and process to control pollutants in water surrounding a drydock is provided. The drydock pollution control system includes a housing extending about the entire perimeter of the drydock, or could extend from each end of the drydock wing walls located on the perimeter, so as to completely encircle the inboard deck or top surface of the drydock. The drydock wing walls contain buoyancy tanks, that are used to move the deck between a floating position and a submerged position upon emptying and filling the tanks with water. The housing of the present invention includes a slot to allow installation of a removable screen assembly in an opening of the housing. Each screen assembly, positioned in its own opening in the housing, allows the water to flow to and from the deck, as the deck moves between the floating position and the submerged position. Additionally, a plurality of baffle plates are positioned on the inboard drydock deck to inhibit movement of pollutants between each baffle plate and the housing extending around the perimeter of the deck of the drydock.

Advantageously, a process for controlling pollutants in the water surrounding a drydock includes removal of the screen assembly from the housing due to concerns of damage of the assembly from ultraviolet effects or from welding operations during maintenance and repair of a drydocked vessel.

BRIEF DESCRIPTION OF THE DRAWINGS

The objects, advantages and features of the invention will become more apparent by reference to the drawings which are appended hereto, wherein like numerals indicate like parts and wherein an illustrated embodiment of the invention is shown, of which:

FIG. 4 is a front elevational view of the pollution control screen assembly of the present invention (the rear of the screen assembly is a substantial mirror image of the front of the screen assembly);

FIG. 5 is a section view of the screen assembly of the present invention taken along lines 5—5 of FIG. 4;

FIG. 6 is an enlarged plan view of the pollution control housing, as shown in FIG. 2, with the screen assembly shown in an operational position, with a portion of the housing and screen assembly shown cut away to better illustrate components the housing used in cooperation with the screen assembly;

FIG. 7 is an elevational section taken along the housing and screen assembly of FIG. 6;

FIG. 8 is an enlarged exploded perspective view of a corner portion of the screen assembly of the present invention;

FIG. 9 is an alternative embodiment of the present invention showing a section view, similar in orientation to FIG. 3, with a vessel having a propeller shroud and rudder assembly, as shown in phantom view, and, additionally, a floating, but not submersible, float or barge is shown positioned adjacent to the drydock system of the present invention below the vessel;

FIG. 10 is a section view taken along lines 10—10 of FIG. 9 showing a plan view of the alternative embodiment of the present invention but with the upper 2" angle iron removed.

DETAILED DESCRIPTION OF PREFERRED EMBODIMENT

The preferred embodiment of the drydock pollution control system, generally indicated as 10, is shown in FIGS. 1–7. An alternative embodiment of the drydock system including a modular housing used to adapt the preferred embodiment to different type vessels is shown in FIGS. 9 and 10. The system is used in a process, as described below in detail, for controlling pollutants in water surrounding a drydock upon submersion of the drydock while facilitating maintenance and repair of the system.

Figure 1:
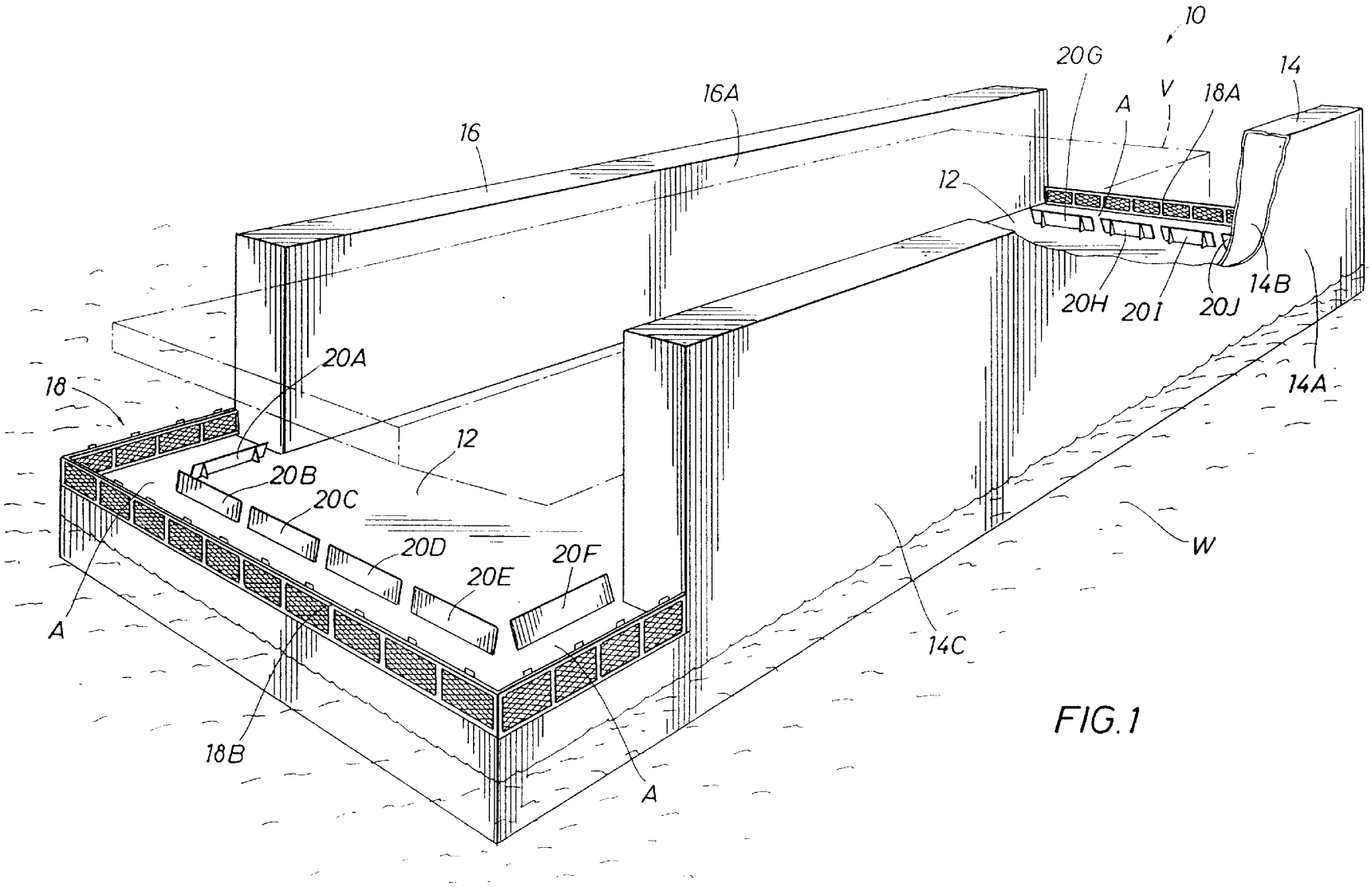
FIG. 1 is a perspective view of the drydock pollution control system of the present invention with a vessel, shown in phantom view, and one of the two upright buoyancy tank wing walls being shown in a cut away view to better illustrate the system in the rear of the drydock.

Turning to FIG. 1, the drydock pollution control system 10 is shown in a floating position. The conventional drydock, which is usually docked near a shore, includes a deck or top surface, generally indicated at 12, inboard of the perimeter of the drydock. Usually, on each side of the drydock are conventional parallelepiped wing walls 14 and 16 with respective buoyancy tanks 14A and 16A. A chamber 14B, as best shown in FIG. 1, for buoyancy tank 14A, similar to the chamber for tank 16, can be filled with fluid, such as the surrounding water, to submerge the drydock with the vessel V located on the drydock. The outer wall of each buoyancy tank, such as exterior wall 14C, fabricated from steel is solid. In the surface preparation, paint removal, sanding and subsequent painting of the vessel V, pollutants, such as spent abrasives from the sand blasting, paint chips, rust and dust accumulate on the top surface of the drydock. As best shown in FIG. 1, when the drydock pollution control system is used with a drydock having wing walls, the system includes a housing, generally indicated at 18, at each end of the drydock system 10 positioned about the perimeter of the drydock. In the illustrated drydock system, the first section 18A of the housing 18 extends in a straight line between the rear ends of buoyancy tanks 14A and 16A on the perimeter of the rear end of the drydock. The section 18B of the housing 18, at the front end of the drydock, extends from the front end of buoyancy tanks 14A and 16A around the perimeter of the drydock in a U-shaped configuration. The fabrication of the housing 18 of the system is similar for both sections 18A and 18B, as will be discussed below in detail.

Figure 2:
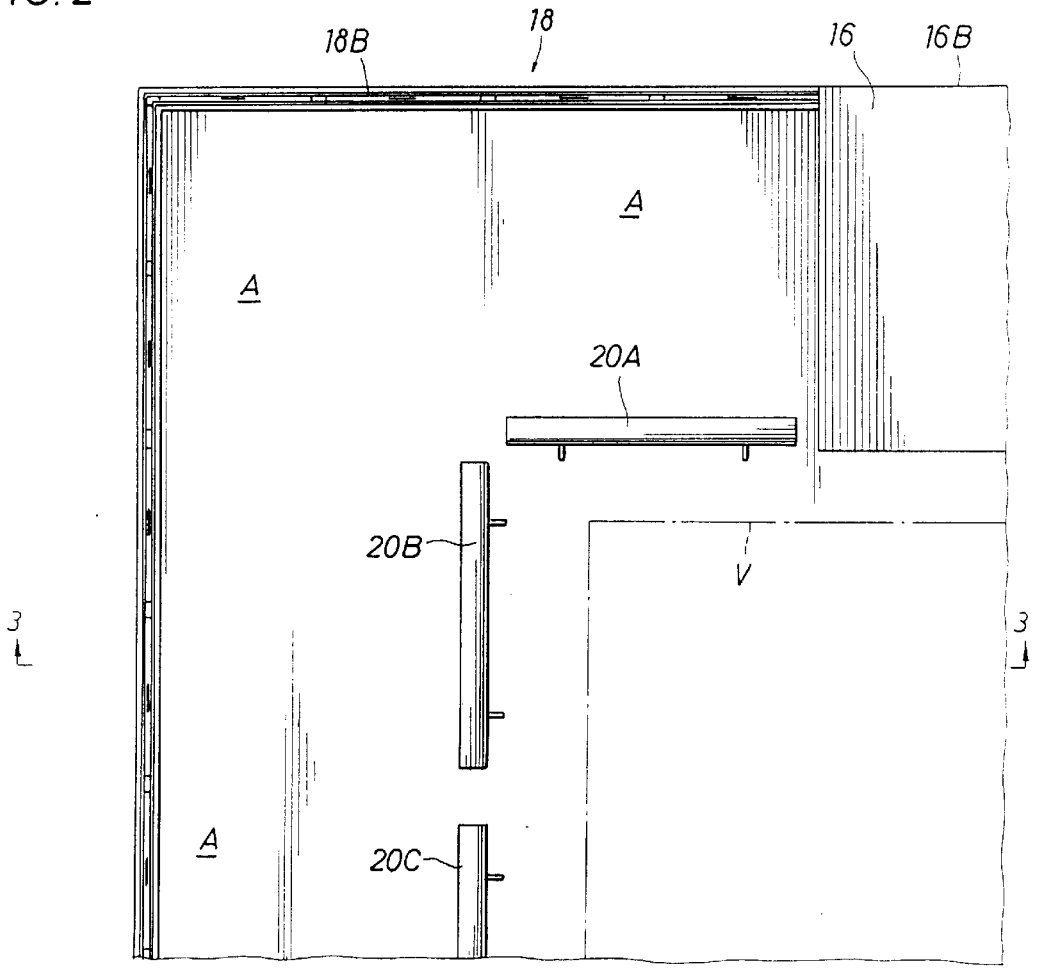
FIG. 2 is an enlarged plan view of the front top corner of the drydock system shown in FIG. 1.

Inboard on the deck 12 of the drydock system 10 are a plurality of baffle plates 20A, 20B, 20C, 20D, 20E, 20F, 20G, 20H, 20I and 20J. These baffle plates are fixedly secured to the deck 12 of the drydock. Preferably, the baffle plates are fixed approximately 7.5 feet inboard of the housing 18 and are constructed from sheets of ¾" plate steel, 16"×8' long. Preferably, the baffle plates are welded to the deck 12 of the drydock at a 70° angle with each baffle plate spaced 16" from its adjacent baffle plate to permit movement by workers on the deck during drydock activities. The main purpose the 70° angle of the baffle plate is to control the movement of the pollutants when the drydock is being raised out of the water. This approximately 7.5 feet inboard area of the deck 12, between the housing 18 and the baffle plates, is generally referred to as the apron A, as best shown in FIG. 2. If the drydock used in conjunction with the present invention does not include the above discussed conventional wing walls, the housing 18 would preferably extend around the entire perimeter of the drydock to completely encircle the deck and corresponding inboard baffle plates would be installed.

Figure 3:
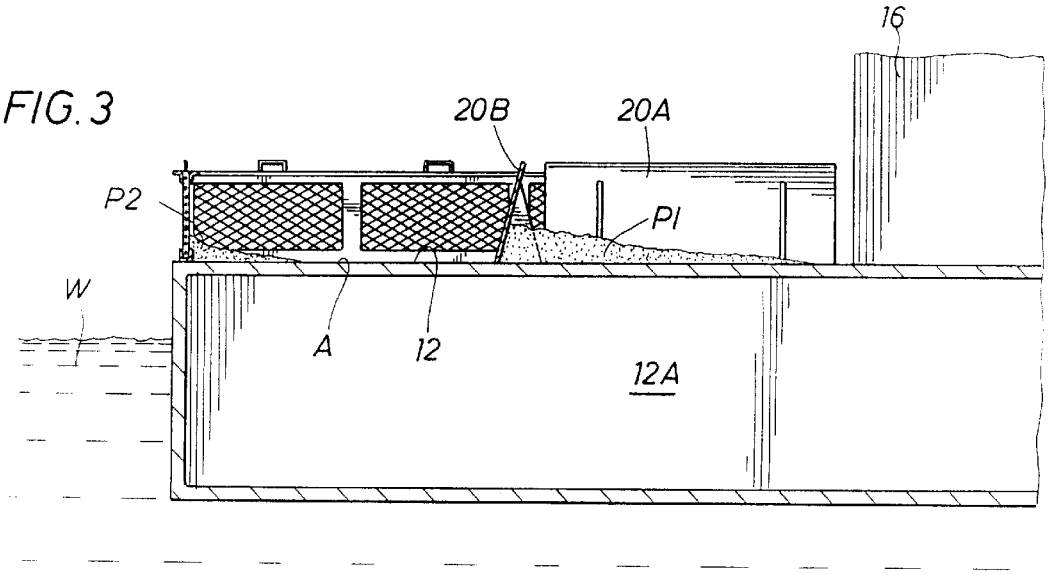
FIG. 3 is a section view taken along lines 3—3 of FIG. 2 of the drydock system.
Figure 11:
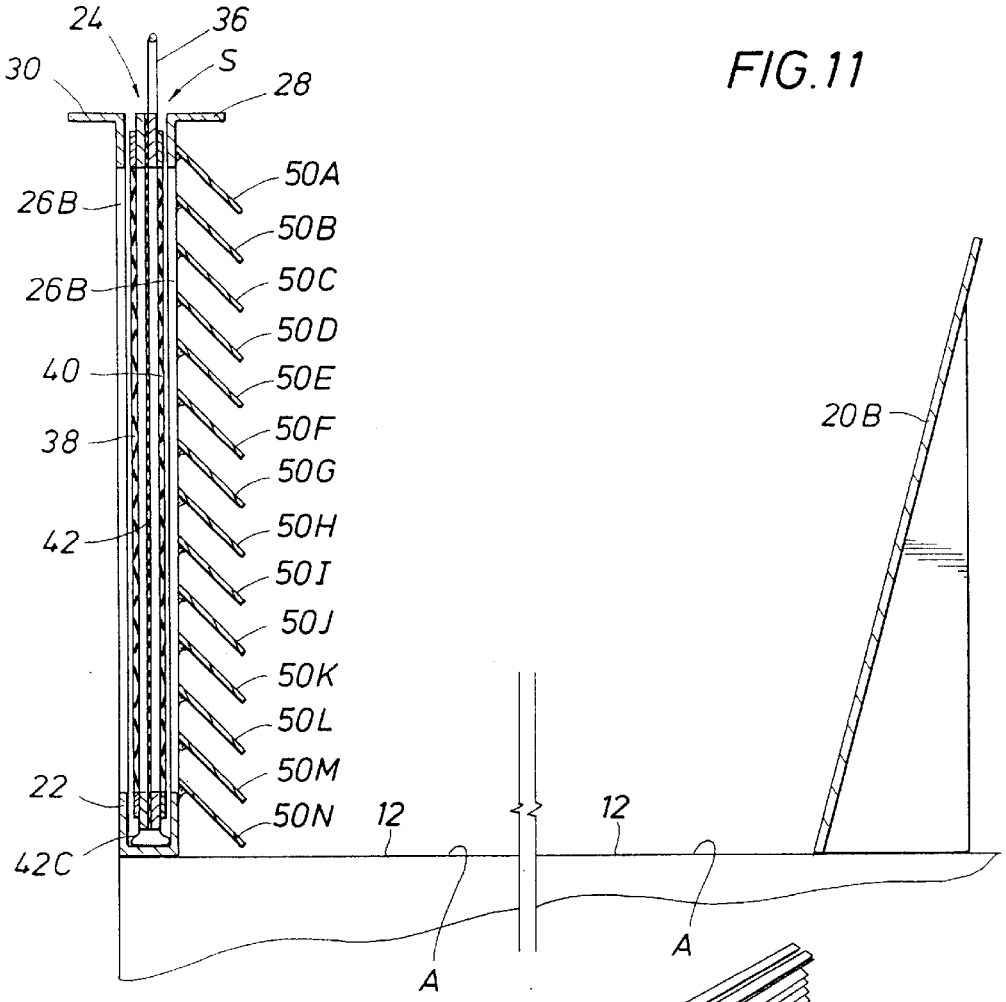
FIG. 11 is a view similar to FIG. 7 with fourteen skimmer plates positioned relative to the baffle plate.
Figure 12:
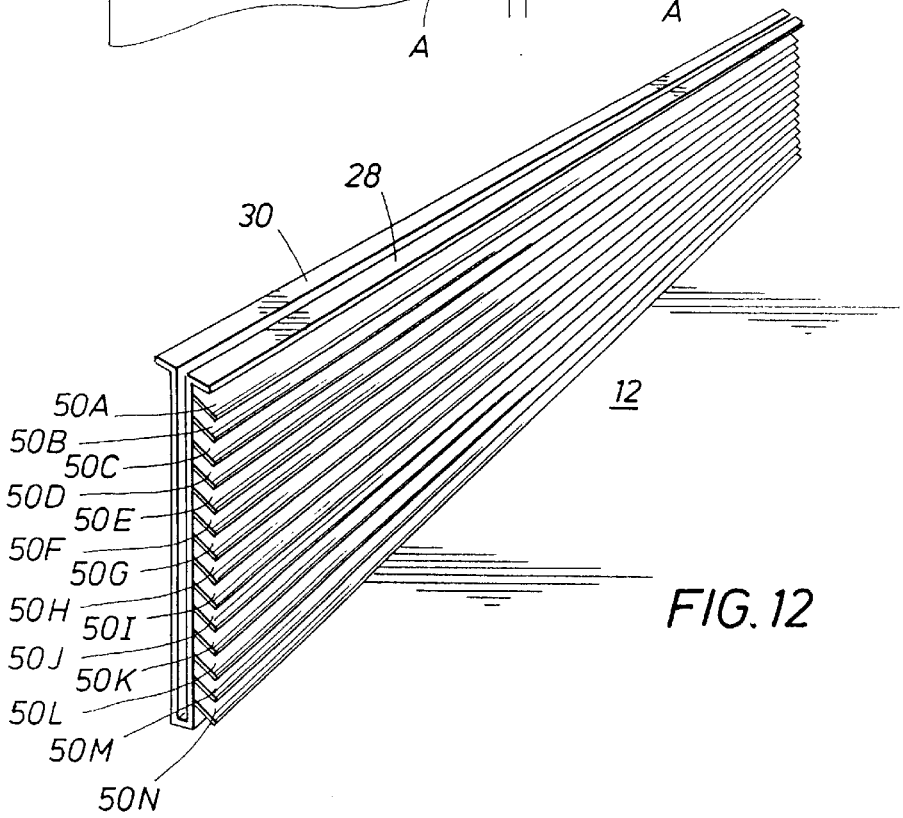
FIG. 12 is a perspective view of the skimmer plates, as shown in FIG. 11.

As best shown in FIG. 2, preferably the drydock system 10 is sized so that the vessel V footprint will fall inboard of the baffle plates, such as vessel V shown inboard of both the apron A and baffle plates 20A, 20B and 20C. In this preferred situation, the majority of the pollutants P1 will fall behind the baffle plates, such as shown in FIG. 3. However, because some abrasives are propelled by a sandblaster, paint propelled by sprayers or other pollutants that are airborne by wind conditions, it is contemplated that some pollutants P2 will land on the apron A between the baffle plates and the housing 18, such as shown in FIG. 3.

Turning now to FIGS. 6 and 7, an enlarged section of the preferred embodiment of the housing 18 is shown. In fabrication of the preferred housing, a 2" piece of channel iron 22 is welded around the perimeter of the apron to provide a bottom support for a screen assembly, generally indicated as 24, as shown in FIGS. 4, 5, 6, 7 and 8. The channel iron 22 is preferably welded to the ends of the buoyancy tanks 14 and 16, as discussed above, to encircle the deck 12 with no separation. The upwardly extending edge facing inwardly to the deck 12 of the 2" channel iron 22 would have a height of 1½" to provide an initial solid wall for control of pollutants P2. Preferably, 2" channel iron, such as 26A, 26B, 26C, 26D, as shown in FIG. 6, are welded to channel iron 22 to extend 13½" in height upright from the channel iron 22. The upright channel iron provides a first shoulder, such as shoulder 26C1, and a second shoulder, such as shoulder 26C2, to limit movement of the screen assembly 24, as best shown in FIG. 6. Two sections of 2" angle iron 28 and 30 are then preferably welded to the top of the upright channel iron, such as 26A, 26B, 26C and 26D to provide a slot, generally indicated as S, therebetween having a width of approximately 2". The housing would therefore have a preferred overall height of 17" (1½"+13½"+2") from the deck 12 and having a spacing of approximately 26" between the upright channel iron (e.g. 26B, 26C).

Turning to FIGS. 4, 5 and 6, the typical screen assembly 24, which weighs approximately 12½ pounds, comprises two hot-dipped galvanized frames 32 and 34. The galvanized frames are preferably fabricated from four pieces of 1¼" 10 gauge flat bar welded into a rectangle of 25"×16" exterior dimensions. As shown in FIGS. 4, 5, 6 and 7, a handle 36 is preferably welded to one of the frames, in this case frame 34, to facilitate installation and removal of the screen assembly 24 in the housing 18. Preferably, welded across the outside face of each frame 32 and frame 34 is a 25"×16" piece of ¾ galvanized expanded metal 38, 40, respectively, as shown in FIGS. 4, 5, 6, 7 and 8. The expanded metal 38, 40 provides the screening material 42 with support against the weight of the water and suspended pollutants, and protection from damage during installation, removal and storage. Preferably, the hot-dipped galvanized expanded metal is a Model No. 0001 fabricated by Jestex, Inc. of Houston, Tex. The size of the diamond shaped openings in the expanded metal are preferably 1¾" in length and ¾" in height. Preferably, the frames 32, 34 and the respective expanded metal 38, 40 are zinc hot-dip galvanized coated per the ASTM: A123-89a process. This process for the preferred embodiment was performed by Southwest Galvanizing Co. of Houston, Tex.

As best shown in FIGS. 4, 5, 6 and 7, the screen material preferably extends approximately 3" beyond the length of the bottom and sides of the frames 32 and 34 during assembling of the screen assembly, so that loops approximately 1½" in length is provided upon overlapping the screen. In particular, loops 42A, 42B are provided on each side and loop 42C is provided on the bottom of the assembly. As can be seen in FIG. 6, the loops 42A and 42B on each side of the installed assembled screen assembly 24 are partially compressed to inhibit movement of pollutants between the screen assembly 24 and the housing 18. Also, as best shown in FIG. 7, the loop 42C at the bottom end of the typical screen assembly 24 is compressed by the weight of the screen assembly 24 to inhibit movement of pollutants between the channel iron 22 and the housing 18. Therefore, the pollutant P2 would need to travel 1½" over the upwardly extending channel iron 22 and down to the screen loop 42C, where it would be inhibited in its movement. Preferably, in assembling of the typical screen assembly 24, a plurality of evenly spaced stainless steel bolts, such as bolt 44, with corresponding conventional nuts (not shown) are used to fasten the frames 32 and 34 and their welded expanded metal 38 and 40, respectively, with the screen material 42 therebetween. The use of reusable fasteners, such as a nut and bolt fastener, as compared to a rivet, would facilitate repair of damaged components of the screen assembly 24 or periodic replacement of a worn screen 42.

Preferably, the screen 42 is fabricated from "ARMORLON" ATG 6 fire-retardant 85% polypropylene fabric. This ATG 6 fire-retardant fabric is manufactured by Reef Industries, Inc. of Houston, Tex. This fabric has a plain weave with a greige finish with 30 fibers in the warp and 23 fibers in the fill directions This material for the screen 42 is ultraviolet stabilized for 6–8 months of outdoor exposure and is available in an off-white color. The Reef Industries, Inc. screen has a standard weight of 6.0 oz/yd$^2$ (41.7 lbs/1,000 ft$^2$), a thickness of 25 mils., a grab tensile strength of 415 lbf warp (MD) and 327 lbf fill (TD), a grab tensile elongation of 39% warp (MD) and 14% fill (TD), a trapezoidal tear strength of 132 lbf warp (MD) and 131 lbf fill (TD)), a dart impact strength of 7.8 lbs., a puncture strength of 116 lbf, a burst strength of 630 psi, flame retardance of 3.25 in, apparent opening size of 40 US Std sieve, permittivity of 2.36 sec$^{-1}$, permeability of 0.15 se$^{-1}$, airflow rate of 338 ft$^3$/min and a water flow rate of 181 gal./min/ft$^2$.

Alternatively, instead of or in combination with the loops 42A, 42B and 42C, a sealant could be used to seal the housing 18 with the screen assembly 24. In particular, as best understood in referring to FIG. 7, a sealant could be applied between the frame 34 and the channel members 26C, 26B and 22, or just applied to the bottom channel member 22 and the frame 34. A preferred sealant is Dow Corning 700 clear industrial grade silicon sealant, manufactured by Dow Corning Corporation of Midland, Mich. A supplier of the sealant is Texas Marine of Houston, Tex.

Turning now to FIGS. 9 and 10, an alternative embodiment is shown of the present invention where a vessel V', as shown in phantom view, has a propeller shroud PS and a rudder R. As best shown in FIG. 9, the vessel V' drive shaft D turns a propeller (not shown) within the propeller shroud PS. Rearwardly of the propeller shroud PS is the vessel rudder R. In this alternative embodiment, the vessel V' is oversized for the drydock and includes the rudder/propeller assembly, as compared to the preferred embodiment. Therefore, the exterior of the vessel V' is not inboard of the baffle plates, as shown in FIG. 2 of the preferred embodiment, and the rudder/propeller assembly is aligned with the perimeter of the drydock. As with vessel V, the vessel V' is positioned on wooden blocks B1, B2, but the propeller shroud PS of vessel V' is additionally positioned on a wooden block B3 in the apron A'. Blocks B2 and B3 rest on the deck or top surface 12' of the drydock system 10'. Since the end of the vessel V' extends over the perimeter of the drydock, a float or barge F having a solid upright retaining wall RW is docked to the system 10' under the end of the oversized vessel V'. The barge F, shown in FIGS. 9 and 10, is not designed to be submerged and raised with the drydock 10'.

In the alternative embodiment, a modular housing 46 is fabricated and sized similar to the housing 18, so as to receive a typical screen assembly 24. However, the modular housing is designed as individual housings for each screen assembly. Each modular housing 46 comprises a 2" channel iron, similar to channel iron 22 of the preferred embodiment, 2" upright channel irons, such as irons 26B', 26C' in FIG. 10, similar to the upright channel irons 26B, 26C in the preferred embodiment, and the 2" angle irons (not shown), similar to top angle irons 28 and 30, to provide a typical 2" slot S'. Each modular housing 46 can be anchored to the deck 12' of the drydock 10' by bolting a leg, such as leg 48 having a hole therein, using nuts and bolts, to the deck 12. Alternatively, the legs 48 and/or the bottom channel member 22' could be welded directly to the apron A' section of the deck 12'. Though not shown in FIGS. 9 and 10, baffle plates would be used, as space permitted, in the alternative embodiment. For example, the baffle plates 20A, 20B, 20E and 20F, as shown in FIG. 1, could be used, even though the baffle plates 20C and 20D would be removed because of interference with the rudder/propeller shroud assembly.

Additionally, the drydock system could have a plurality of skimmer plates 50A, 50B, 50C, 50D, 50E, 50F, 50G, 50H, 50I, 50J, 50K, 50L, 50M and 50N positioned inboard of each housing opening. The skimmer plates are to be positioned substantially parallel to each other and slanted downwardly as the skimmer plates extend inboard from the housing. It is also contemplated that other skimmer plate configurations could be used, such as the configurations disclosed in U.S. Pat. No. 4,000,618 which is incorporated herein by reference for all purposes. Preferably, fourteen slanted parallel plates 50A, 50B, 50C, 50D, 50E, 50F, 50G, 50H, 50I, 50J, 50K, 50L, 50M and 50N would extend downwardly as they extend inwardly away from the housing. These parallel skimmer plates would not only provide protection from damage done by nearby welding and UV radiation sources but would further control movement of pollutants that would have to move upwardly as they moved out from the apron A. However, these parallel skimmer plates are not considered critical, since the screen assemblies 24 can be removed during drydock activities. It is also contemplated to replace the expanded metal with a steel bar or hardware cloth designed to provide structural support against the force of the moving water or using other screen assemblies with other configurations and fabrication.

Another alternative embodiment would be the use of a housing having a ⅜" steel plate wall, 18" in height above the deck 12 welded about the perimeter of the apron A. Windows 19" in length by 15" height would be cut 1.5" above the deck 12 with a 3' separation between each window. On the inboard face of the plate wall 2" angle irons would be welded such that a 2" channel having a height of 18" is formed. These formed channels were spaced apart so as to receive a zinc coated steel mesh filter having an actual size of 19½" height, 24½" width and 1¾" depth. Such a filter is manufactured by The George Evans Corporation of Moline, Ill. having Evans Model No. 20252AGS and Stock No. 4C409. The supplier of the filter used in the testing was Grainger of Houston, Tex. In combination with the filter, a screen fabricated from the above discussed "ARMORLON" ATG 6 fire-retardant 85% polypropylene fabric was hung from a bar approximately 6" above the deck at one end on the inside of the filter, on the deck side, to cover a portion of the filter and its other end secured near the deck and away from the filter. Therefore, the screen did not span the opening. Upon inflow of water the screen would move outwardly away from the filter to facilitate inflow of water but upon outflow of water the screen would be pushed against the filter. In this embodiment, the screen is not designed to be removable, as in the preferred embodiment. This 2" channel created by the wall and the 2" angle iron provided first and second shoulders to hold the filter.

This alternative embodiment for the drydock pollution control system was tested in 1996 and met the effluent limitations for the Texas Natural Resource Conservation Commission, Permit No. 02034, issued to Newpark Shipbuilding and Repair, Inc. of Houston, Tex. The preferred embodiment housing 18, that has also been used by Newpark Shipbuilding and Repair, Inc., is preferred over the alternative embodiment of the housing because of the additional screened openings that allow more flow of water upon submersion and raising of the drydock. It is also contemplated that the frame 32 or 34 of the screen assembly could be bolted directly to the solid housing wall of the alternative embodiment housing.

It is also contemplated that a swab test will be performed on vessels in drydock to detect lead before sandblasting/painting. If the test reads positive for lead, a lab analysis will be performed to determine whether the lead content exceeds applicable action levels If the lead content exceeds the applicable action levels, the drydock will be swept clean before submersion and spent sandblast and paint chips containing lead shall be legally disposed of. Such lead check swabs are available commercially, such as stock number Lead 8, containing eight swabs, and stock number Lead 16, containing sixteen swabs, distributed by Hybrivet Systems, Inc. of Natick, Mass. A test swab cartridge type device and method of detecting lead and cadium assigned on its face to the Hybrivet Systems, Inc. of Framingham, Mass. is disclosed in U.S. Pat. No. 5,039,618. Also, a lead detector kit is disclosed in U.S. Pat. No. 4,786,604; and a swab identification testing device and method is disclosed in U.S. Pat. No. 5,492,835. U.S. Pat. Nos. 4,786,604; 5,039,618 and 5,492,835 are incorporated herein by reference for all purposes.

PROCESS

Before submersion of the pollution control drydock system 10 or 10', any low density or floatable rubbish would be picked up from the drydock. Any loose pollutants such as spent abrasives would then be swept from the apron A between the baffle plates 20A, 20B, 20C, 20D, 20E, 20F, 20G, 20H, 20I and 20J and the housing sections 18A and 18B, as best shown in FIG. 1, 2 and 3 in the preferred embodiment, and/or from the apron A' inboard of the modular housing 46 of FIGS. 9 and 10 to a location inboard of the baffle plates, as discussed above, and the wooden blocks B1 and B2. Though this presubmersion sweeping may not be necessary to comply with federal and state regulations, it would improve the efficiency of the process. However, it is contemplated that the apron A", between the modular housing 46 and the perimeter of the drydock, would always be swept clean before submersion because of lack of control of pollutants in that area. In the process for the alternative embodiment, shown in FIGS. 9 and 10, the float or barge F would be disengaged from the drydock before submersion and cleaned, if appropriate.

After the drydock has submerged and resurfaced it is preferable to remove each screen assembly 24 and store them away from UV radiation and welding areas until needed again. This storage of the screen assemblies insures the longevity of the system.

TESTING

A model of a pollution control drydock system was built and tested in a fish tank before the testing of the system using an alternative embodiment housing, as discussed above. This testing of the model in 1996 supported the initial theory that upon submersion of the drydock system, the pollutants, such as spent abrasives, and rust remained in the drydock system having a housing with a plurality of screens and did not float away. For example, the sandblasting media is generally a silica propelled under high pressure for the purpose of cleaning and preparing a surface for painting. Specific gravity of material is calculated by the density of the material over the density of water. For example, steel 1020 has a specific gravity of 7.86, steel 1040 has a specific gravity of 7.85, cast iron (gray) has a specific gravity of 7.15, aluminum alloys have a specific gravity of 2.7 (+), ceramics, such as silica, have a specific gravity of 1.75. Therefore, even with the inflow and outflow of water to and from the top surface, the tested model supported the theory, later proven in the alternative embodiment testing, that pollutants, including the metals and ceramics (silica) because of their higher specific gravity, would be contained in the drydock system of the present invention having a housing with a plurality of screens. It should be noted that some polymers, such as polyethylene, have a specific gravity less than water, and, that is why these plastics and other low density and floatable rubbish should be removed from the drydock system before each submersion.

The foregoing disclosure and description of the invention are illustrative and explanatory thereof, and various changes in the size, shape and materials, as well as the details of the illustrated construction may be made without departing from the spirit of the invention.

We claim:

1. A drydock pollution control system to control pollutants in water surrounding a drydock, comprising:

a top surface having an apron and disposed on the drydock; said top surface moving from a floating position to a submerged position;

a pollution control housing having an opening, said housing extending upwardly from a portion of said top surface;

a screen positioned in said housing to span said opening to control pollutants in the water surrounding the drydock while allowing water to flow to and from the top surface; and a baffle plate positioned adjacent the apron of said top surface to inhibit movement of pollutants between said baffle plate and said housing.

2. The system of claim 1 wherein said drydock including a wall defining a first buoyancy tank extending upward from said top surface and said housing positioned adjacent said wall to provide a barrier to said portion of said top surface.

3. The system of claim 2 wherein said drydock includes a second buoyancy tank spaced apart from said first buoyancy tank, said second tank having a wall extending upward from said top surface, said housing having a first section and a second section, said first section of said housing positioned between said first tank wall and said second tank wall and said second section of said housing positioned between said first tank wall and said second tank so that said walls and said housing sections encircle a portion of said top surface.

4. The system of claim 1 further comprising:

a first frame; and a second frame coextensive with said first frame, said screen is fixedly positioned between said first frame and said second frame.

5. The system of claim 4 further comprising:

a first structural member having a plurality of ports and sized to span said first frame;

a second structural member having a plurality of ports and sized to span said second frame; and said screen positioned between said first structural member and said second structural member.

6. The system of claim 5 wherein said housing further comprising:

a first upright member having a first shoulder and a second shoulder;

a second upright member having a first shoulder and a second shoulder; and said first shoulders and said second shoulders limit movement of said frames.

7. The system of claim 1 wherein said screen is fabricated from polypropylene.

8. The system of claim 1 wherein said housing having an elongated slot sized to allow said screen to be removably positioned in said housing.

9. The system of claim 8 further comprising:

a handle disposed on said screen to facilitate removal of said screen from said slot.

10. The system of claim 1 wherein said housing being substantially perpendicular to said top surface.

11. The system of claim 1 wherein said baffle plate is positioned at angle of approximately 70° to said top surface to inhibit movement of pollutants between said baffle plate and said housing.

12. The system of claim 1 wherein said housing is continuous about the perimeter of said top surface.

13. The system of claim 1 further comprising a vessel having a rudder and propeller shroud assembly wherein said housing is modular to allow positioning of said housing on said top surface about said rudder and propeller shroud assembly.

14. The system of claim 1 wherein said drydock having an inboard and said system further comprising a plurality of skimmer plates positioned inboard of said housing opening, said skimmer plates being substantially parallel to each other and slanted downwardly as said skimmer plates extend away from said housing opening.

15. A drydock pollution control system to control pollutants in water surrounding a drydock, comprising:

a first buoyancy tank having a wall with a first end and a second end disposed on the drydock;

a second buoyancy tank having a wall with a first end and a second end disposed on the drydock;

a top surface having an apron, said top surface moving from a floating position to a submerged position upon filing said tanks with water;

a housing having an opening;

an elongated slot in said housing, said slot communicating with said opening in said housing;

said housing having a first section and a second section, one section of said housing extending between one end of the first buoyancy tank wall and one end of the second buoyancy tank wall and the other section of said housing extending between the other end of the first buoyancy tank wall and the other end of the second buoyancy tank wall to encircle a portion of said top surface;

a screen removably positioned in said housing opening through said slot to control pollutants in the water surrounding the drydock while allowing water to flow to and from the top surface as said top surface moves between the floating position and the submerged position; and a baffle plate positioned adjacent the apron to inhibit movement of pollutants between said baffle plate and said housing.

16. A process for controlling pollutants in water surrounding a drydock, comprising the steps of:

positioning a housing having an opening on a top surface of the drydock to encircle a portion of the top surface having pollutants;

positioning a removable screen so as to span said housing opening;

submerging the drydock thereby allowing flow of water through said screen onto said encircled top surface;

raising the top surface above said surrounding water;

filtering pollutants from the water above said encircled top surface as the water flows through said screen; and positioning a baffle plate within said encircled portion of the top surface to inhibit movement of pollutants between said baffle plate and said screen.

17. The process of claim 16 further comprising the step of:

removing the screen from said housing through a slot in said housing after the step of a.) raising the top surface to a floating position, and b.) filtering the water from the encircled top surface through said screen.

18. The process of claim 19 further comprising the step of:

replacing the screen in the housing before the step of submerging the drydock.

19. A drydock pollution control system to control pollutants in water surrounding a drydock, comprising:

a top surface disposed on the drydock; said top surface moving from a floating position to a submerged position;

a pollution control housing having an opening, said housing extending upwardly from a portion of said top surface;

a screen positioned in said housing to span said opening to control pollutants in the water surrounding the drydock while allowing water to flow to and from the top surface;

said housing having an elongated slot sized to allow said screen to be removably positioned in said housing; and a handle disposed on said screen to facilitate removal of said screen from said slot.

20. A drydock pollution control system to control pollutants in water surrounding a drydock, comprising:

a top surface disposed on the drydock; said top surface moving from a floating position to a submerged position;

a pollution control housing having an opening, said housing extending upwardly from a portion of said top surface;

a screen positioned in said housing to span said opening to control pollutants in the water surrounding the drydock while allowing water to flow to and from the top surface;

a first frame;

a second frame coextensive with said first frame, said screen is fixedly positioned between said first frame and said second frame;

a first structural member having a plurality of ports and sized to span said first frame;

a second structural member having a plurality of ports and sized to span said second frame;

said screen positioned between said first structural member and said second structural member;

a first upright member of said housing having a first shoulder and a second shoulder;

a second upright member of said housing having a first shoulder and a second shoulder; and said first shoulders and said second shoulders limit movement of said frames.

* * * * *